US005654123A

United States Patent [19]

Yang et al.

[11] Patent Number: 5,654,123

[45] Date of Patent: Aug. 5, 1997

[54] MULTILAYER COLOR PHOTOGRAPHIC ELEMENT CONTAINING A SOLUBILIZED BLOCKED DYE MOIETY

[75] Inventors: Xiqiang Yang; Zbyslaw R. Owczarczyk, both of Webster; Daniel L. Kapp, Rochester, all of N.Y.

[73] Assignee: Eastman Kodak Company, Rochester, N.Y.

[21] Appl. No.: 674,223

[22] Filed: Jun. 28, 1996

[51] Int. Cl.[6] ..... G03C 8/08; G03C 8/10; G03C 7/18; G03C 7/305

[52] U.S. Cl. ..... 430/222; 430/226; 430/359; 430/362; 430/504; 430/955; 430/958

[58] Field of Search ..... 430/222, 226, 430/359, 362, 504, 958, 955

[56] References Cited

U.S. PATENT DOCUMENTS

| | | | |
|---|---|---|---|
| 5,354,650 | 10/1994 | Southby et al. | 430/544 |
| 5,455,141 | 10/1995 | Owczarczyk et al. | 430/222 |

FOREIGN PATENT DOCUMENTS

| | | | |
|---|---|---|---|
| 0 483 809 | 5/1992 | European Pat. Off. | G03C 1/83 |
| 0 484 820 | 7/1995 | European Pat. Off. | G03C 1/83 |

*Primary Examiner*—Richard L. Schilling
*Attorney, Agent, or Firm*—Joshua G. Levitt

[57] ABSTRACT

Multilayer color photographic elements are described which contain a release compound that during photographic processing provides an imagewise distribution of a nucleophile which can react with a uniform distribution of a sulfinate blocked dye moiety contained in the element to release a solubilized unblocked dye.

17 Claims, No Drawings

MULTILAYER COLOR PHOTOGRAPHIC ELEMENT CONTAINING A SOLUBILIZED BLOCKED DYE MOIETY

FIELD OF THE INVENTION

This invention relates to a silver halide photographic element that contains a compound which releases a dye moiety as a function of image development during photographic processing.

BACKGROUND OF THE INVENTION

Images are formed in silver halide color photographic materials by reaction between oxidized silver halide developing agent and a dye forming compound known as a coupler. Photographic properties of the image, such as sharpness, granularity, contrast and color reproduction, can be enhanced by the use of compounds which make available an image modifier during processing. An early embodiment was the release from a coupler during photographic processing of a development inhibitor. These compounds were commonly referred to as development inhibitor releasing (DIR) couplers and were first described in U.S. Pat. Nos. 3,148,062 and 3,227,554.

In U.S. Pat. No. 5,354,650 there is described a photographic element in which an image modifier is made available by the interaction of two compounds. Such a photographic element comprises a support bearing at least one silver halide emulsion layer, and contains:

a) a release compound that provides, as a function of development, an imagewise distribution of a compound A that is photographically inert in the form in which it is released; and b) a uniform distribution of a compound B, or its precursor, which is photographically inert in the form in which it is contained in the layer;

but under photographic processing conditions compounds A and B interact to provide an image modifying group.

By employing compounds A and B, which need to interact in order for the photographically active group to be available in its active form, it is possible to target the location where that group operates. Also, these compounds provide a means for incorporating in a photographic element precursors of photographically active groups that otherwise would be unstable.

U.S. Pat. No. 5,455,141 extends the technology described in U.S. Pat. No. 5,354,650 to the release of dyes in photographic elements. One embodiment described in U.S. Pat. No. 5,455,141 provides an alternative to the masking couplers used in photographic elements. Masking couplers are used extensively in color negative photographic elements to correct for the unwanted absorption of image dyes. The masking effect is obtained by imagewise destruction of a dye which has the same hue as the unwanted absorption for which it corrects. The loss of density due to the destruction of the masking dye offsets the unwanted gain in density due to the unwanted absorptions of the image dye.

In the embodiment of U.S. Pat. No. 5,455,141 of interest here, the the photographic element contains:

a) a release compound that provides an imagewise distribution of a nucleophile as a function of silver halide development; and b) a uniform distribution of a dye moiety that is immobilized in the photographic element by a group which is displaceable by the nucleophile;

the nucleophile and the dye moiety being such that they interact under photographic processing conditions to make the dye moiety mobile. Thus, the dye moiety is mobilized, and can be removed from the photographic element, in inverse proportion to the formation of image dye. This provides a convenient alternative to masking couplers.

The sulfinate blocked dye moieties shown in U.S. Pat. No. 5,455,141, are preferred because of their good reactivity with the preferred thiol nucleophiles as well as because of their poor reactivity with other nucleophiles that are uniformly present in the photographic element or the processing solution. We have found that in multilayer color photographic elements the sulfinate blocked dye moieties described in U.S. Pat. No. 5,455,141 unfortunately are not as mobile as had been expected. As a result, the dye which is released on photographic processing is not completely removed from the photographic element, resulting in less than adequate masking and incorrect color rendition.

Filter dye compounds in which a dye moiety is joined to a ballast moiety via a sulfinate linkage are described, for example, in EP Published Patent Applications 0 483 809 and 0 484 820. However, these dye compounds are uniformly removed from the element on processing, and they contain no suggestion that there would be any difficulty in removal of the dye.

It would be desirable to provide multilayer color photographic elements that employ the masking technology described in U.S. Pat. No. 5,455,141, but which utilize sulfinate blocked dye moieties that readily are removed from the element during photographic processing.

SUMMARY OF THE INVENTION

We have found that in multilayer color photographic elements the sulfinic acid group, which remains on the sulfinate blocked dyes after unblocking, interacts with oxidized color developer to form a sulfonamide, which in the case of the dyes shown in U.S. Pat. No. 5,455,141 is a poorly soluble species. This results in the dye moiety not being completely removed from the photographic element. We have found that this problem can be overcome with compounds containing a solubilized dye moiety.

In accordance with this invention, there is provided a multilayer color photographic element comprising:

a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler; and associated with at least one of the dye image-forming units, a) a release compound that provides an imagewise distribution of a compound A, compound A comprising a nucleophile that is imagewise releasable from a carrier group as a function of silver halide development; and b) a uniform distribution of a compound B, compound B comprising a solubilized dye moiety joined by a sulfinate linkage to a blocking group which immobilize the dye moiety in the element and from which it is displaceable by compound A;

compounds A and B, under photographic processing conditions, being capable of interacting to provide an unblocked, mobile, solubilized dye moiety.

This invention provides a multilayer color photographic element in which good color correction is obtained by the use of an immobile, sulfinate blocked, solubilized dye moiety that is removed from the element during processing as a function of silver halide development.

DETAILED DESCRIPTION OF THE INVENTION

As indicated above, compound B comprises a mobile, solubilized dye moiety which is immobilized by attachment to a blocking group from which it is released as a result of reaction with a nucleophile released from compound A.

As used herein, the term "mobile" means the dye moiety is capable of wandering within the hydrophilic layers of a photographic element and of being washed out of the element under conditions encountered during conventional photographic processing.

As used here in the term "solubilized" means the dye moiety has sufficient aqueous phase solubility to be mobile. After release from the blocking group the solubilized dye moieties used in this invention have sufficient solubility in aqueous processing solutions to make them mobile. The desired degree of solubility can be obtained either by the use of a dye moiety which is inherently soluble in water or by the use of dye moiety which contains one or more functional groups that are at least 10% ionized at pH 10. Examples of inherently soluble dye moieties are dicyano methine dyes and cyanomethanesulfonyl methine dyes. Examples of functional groups that are at least 10% ionized at pH 10 when attached to dye moieties are carboxylic acid groups, sulfonic acid groups, acidic sulfonamide groups and phenol groups, or the corresponding salts of such groups, such as the sodium, potassium and ammonium salts.

The dyes moieties of this invention can be selected from any of the known classes of dyes that are used in photographic elements, so long as they are mobile when released from the blocking group. The dye moiety can be selected from dyes in the following classes: arylidene dyes, styryl dyes, butadiene dyes, oxonol dyes, cyanine dyes, merocyanine dyes, hemicyanine dyes, diarylmethane dyes, triarylmethane dyes, azomethine dyes, azo dyes, metal chelate dyes, anthraquinone dyes, stilbene dyes, chalcone dyes, indophenol dyes, indoaniline dyes and coumarine dyes. Preferred are methine dyes and azoaniline dyes.

Blocking groups impart to compound B, among other things, a hallasting effect. In certain instances, depending upon where on the dye moiety they are attached, the blocking groups can also shift the dye hue. Examples of groups which are capable of undergoing an exchange reaction with nucleophiles, and hence acting as blocking groups, are silylethers, disulfides, esters, amides, activated alkenes, and activated arenes.

The dye moiety can be connected to the blocking group through a linking group. Upon displacement of the blocking group from the dye moiety, the linking group remains with the dye moiety. Linking groups generally are introduced into compound B for synthetic ease, but they may also serve other functions, such as modification of the hue of the dye, or serving as a site for the attachment of a solubilizing group. Representative linking groups include alkylene and arylene groups which can contain ester groups, amide groups and ether groups.

Preferred compounds B, can be represented by the following structural formula:

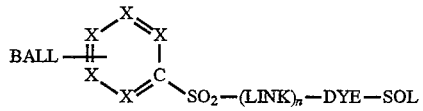

wherein:

X is N or C—R;

R is H or a monovalent substituent;

BALL is a ballast group which renders the compound immobile in the layer in which it is coated;

LINK is a linking group;

n is 0, 1 or 2; and

DYE-SOL is a solubilized dye moiety.

Other preferred compounds B are represented by the structural formula:

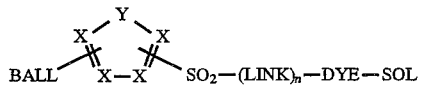

wherein:

Y is O, S, or N—R;

X is N or C—R;

R is hydrogen or a monovalent substituent;

BALL is a ballast group which renders the compound immobile in the layer in which it is coated;

LINK is a linking group;

n is 0, 1, or 2; and

DYE-SOL is a solubilized dye moiety.

Suitable linking groups include alkylene and arylene groups which can contain ester groups, amide groups and ether groups, as well as solubilizing groups such as carboxylic acid groups, sulfonic acid groups, acidic sulfonamide groups and phenol groups, and the corresponding salts of such groups, such as their sodium, potassium and ammonium salts.

Suitable R groups include hydrogen, halogen, alkyl, aryl, carboxy, amido, sulfonamide, nitro, cyano, fluoro, fluoroalkyl, fluorosulfonyl, sulfonamide, aminosulfonyl, alkylsulfonyl, arylsulfonyl, alkylcarbonyl, arylcarbonyl, carboxyalkyl, carboxyaryl and the like.

Representative compounds that are useful in this invention as compound B include the following:

B-1
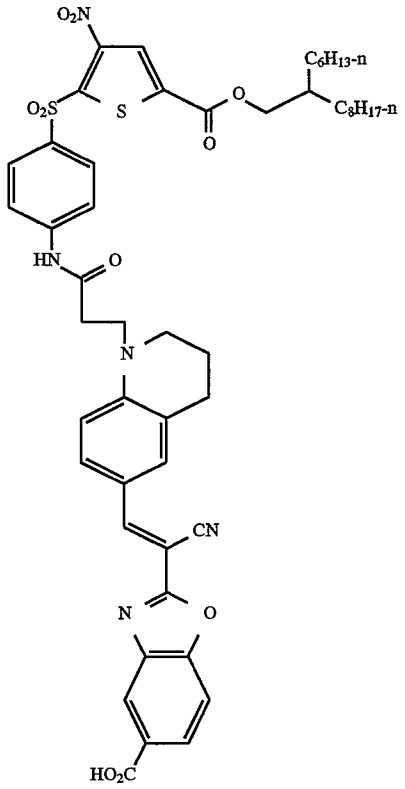
B-2
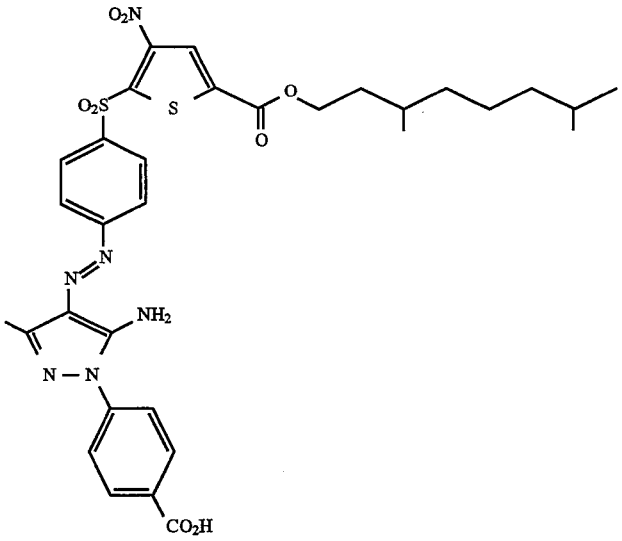

-continued
B-3
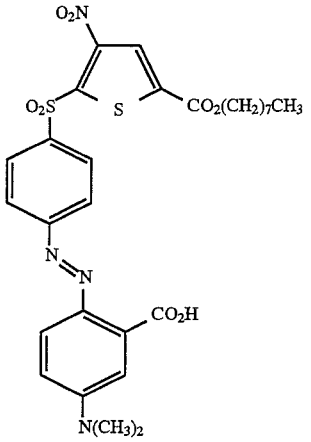
B-4
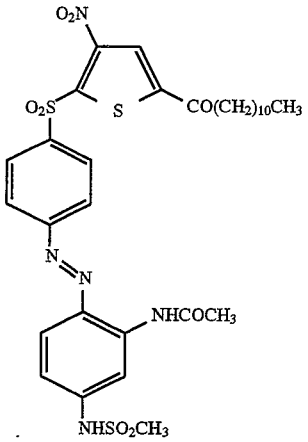
B-5
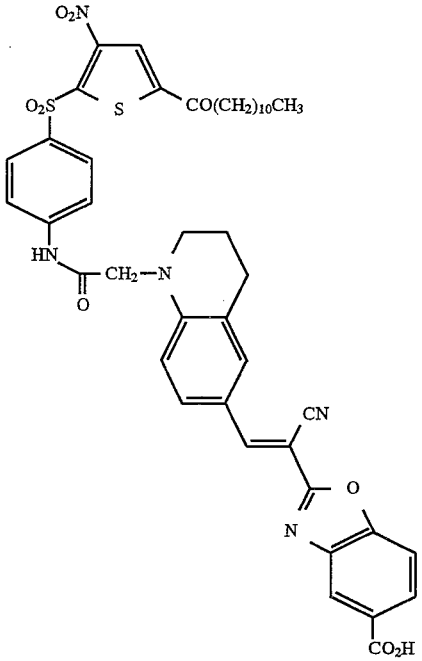
B-6
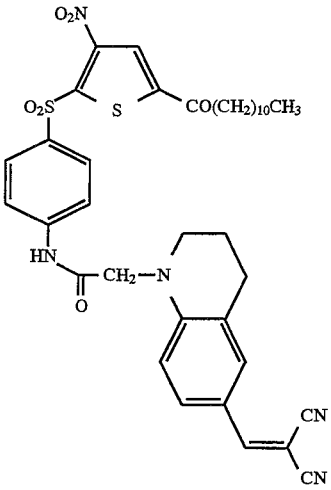

-continued
B-7
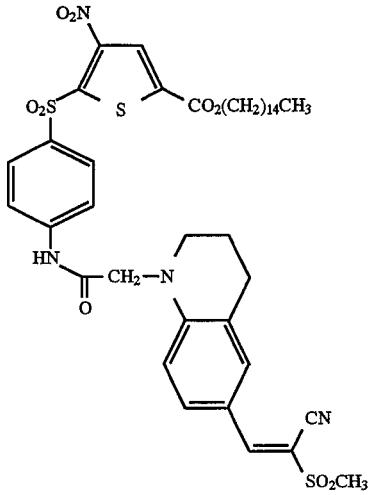
B-8
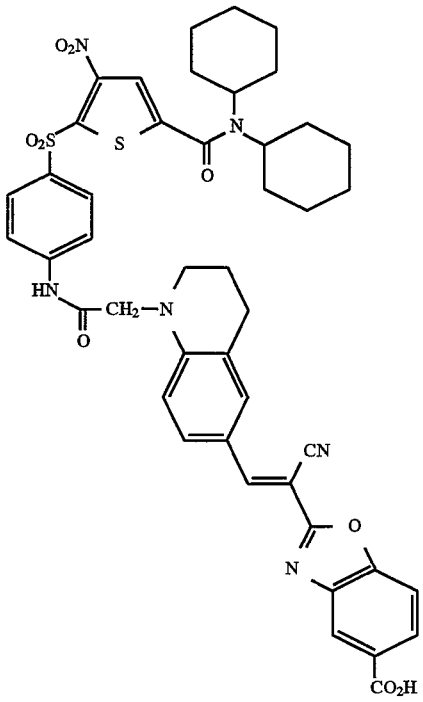
B-9
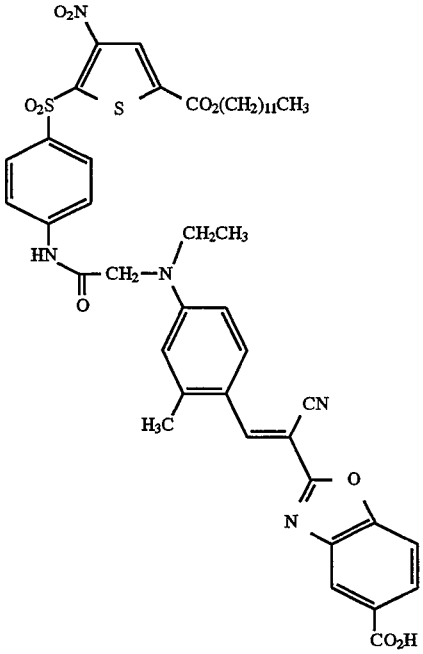
B-10
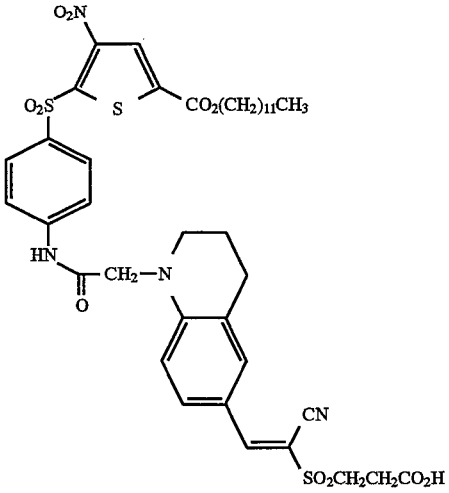

-continued
B-11
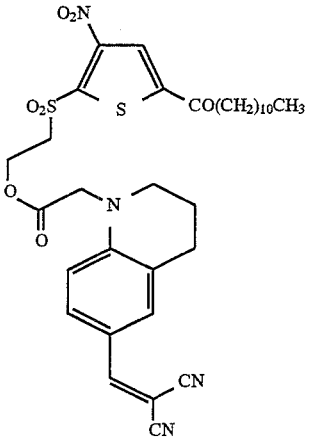
B-12
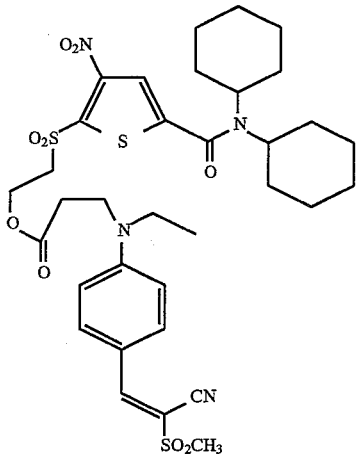
B-13
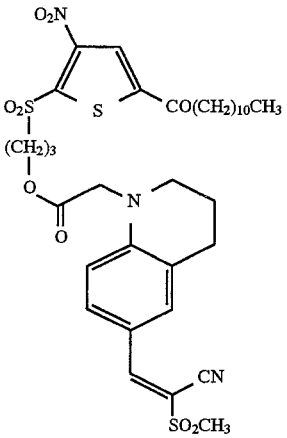
B-14
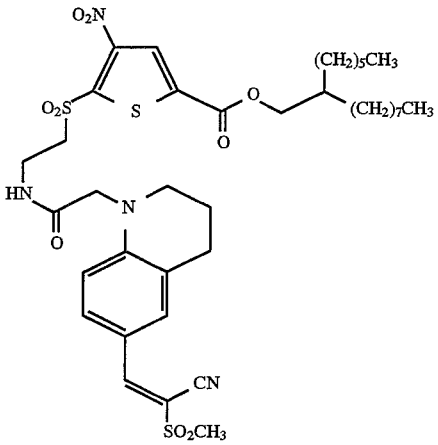
B-15
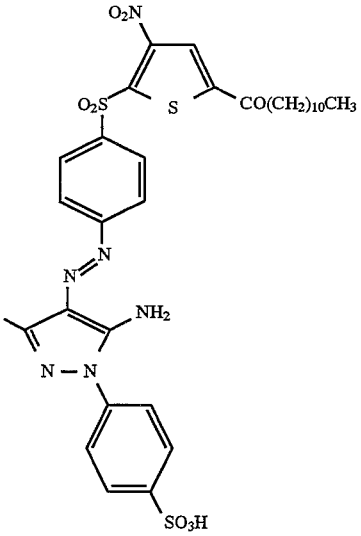
B-16
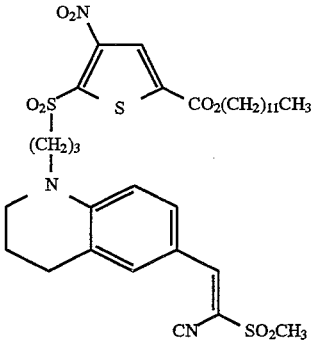

-continued

B-17

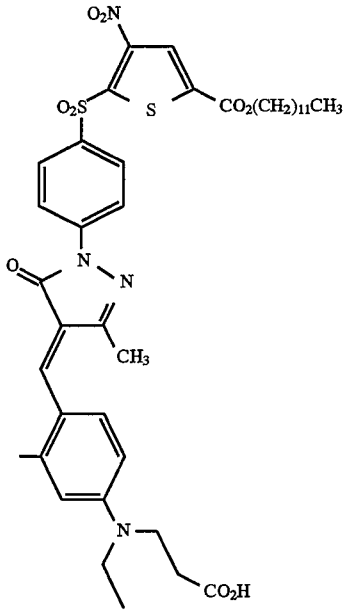

B-18

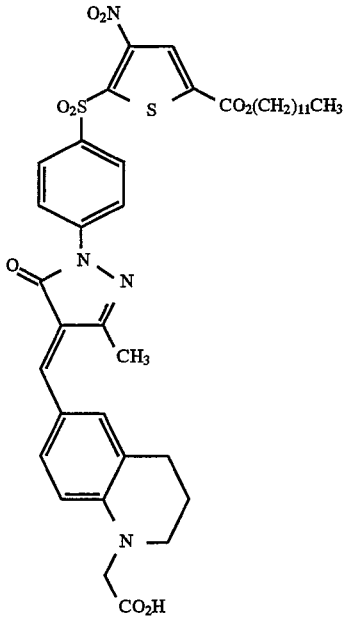

Nucleophiles suitable as compound A are described in Chapter 13 of *Advanced Organic Chemistry*, Third Edition, J. March, published by John Wiley & Sons (1985). They include oxygen nucleophiles (alkoxide and aryloxide) and nitrogen nucleophiles (amines, azides), preferably those other than oximes; halide nucleophiles (iodide, bromide, chloride, fluoride, fluoroborate); carbon nucleophiles (cyanide, acetylide); and sulfur nucleophiles (thiols, thiocyanate, disulfide anion, and sulfinates).

Preferred are aryl, alkyl and heterocyclic thiols which can be substituted with non-interfering groups such as alkyl, aryl, aralkyl, alkaryl, alkoxy, aryloxy, sulfono, amido, sulfonamido, carboxy, halo, nitro and the like.

Particularly preferred compounds A are thiol nucleophiles, such as the arylthiols represented by the structural formulas:

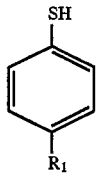

$R_1$ is $CH_3-$, $CH_3(CH_2)_5-$, Cl, or $CH_3(CH_2)_6O-$

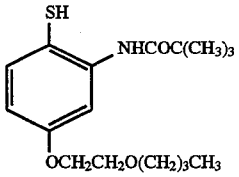

-continued

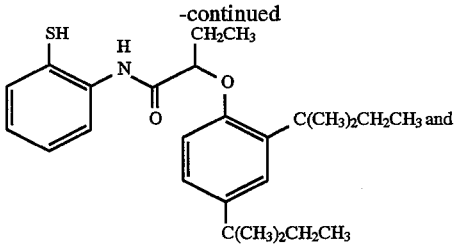

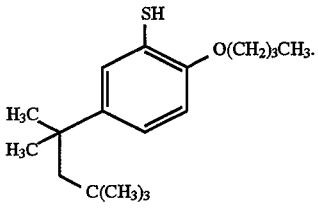

The nucleophile is part of the release compound and is made available as a nucleophile only during photographic processing. Suitable release compounds contain an immobile carrier group from which the remainder of the compound is released during photographic processing.

The carrier can be an oxidizable moiety, such as a hydrazide or hydroquinone derivative, which releases the nucleophile in an imagewise manner as a function of silver halide development. Such blocking groups are described, for example, in U.S. Pat. Nos. 3,379,529 and 4,684,604.

In a preferred embodiment the carrier is a coupler moiety to the coupling position of which the nucleophile is attached so that it is coupled off by reaction with oxidized color developing agent formed in an imagewise manner as a function of silver halide development. Particularly preferred are magenta dye forming couplers, such as pyrazolones and pyrazoloazoles, and couplers which form colorless reaction products.

In any of these embodiments, a timing group can be present between the carrier and the nucleophile. Suitable timing groups are described in U.S. Pat. Nos. 4,248,962; 4,409,323, 4,684,604, 5,034,311, and 5,055,385; and European Patent Application 0 167 168. Examples of release compounds with preferred timing groups from which a nucleophile can be made available are shown immediately below, where CAR is a carrier from which the remainder of the molecule is released during photographic processing and X represents the nucleophile.

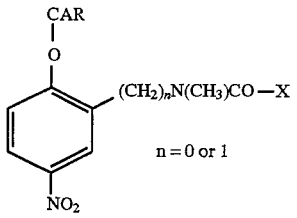

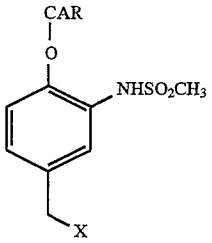

-continued

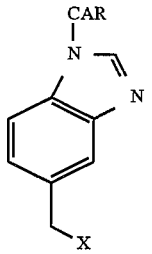

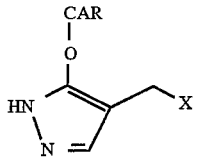

Examples of release compounds from which a nucleophile (compound A) is released in an imagewise fashion are listed immediately below.

A-1

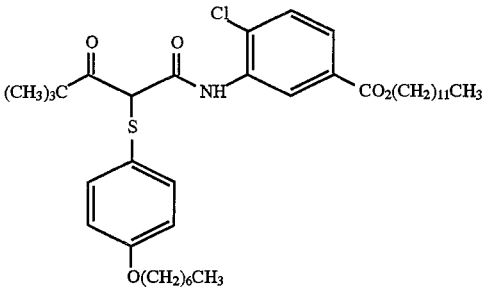

A-2

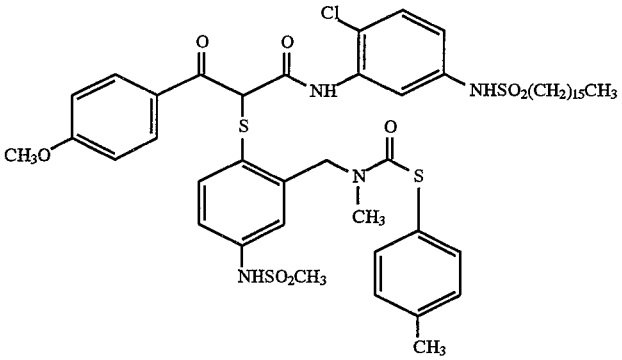

-continued
A-3
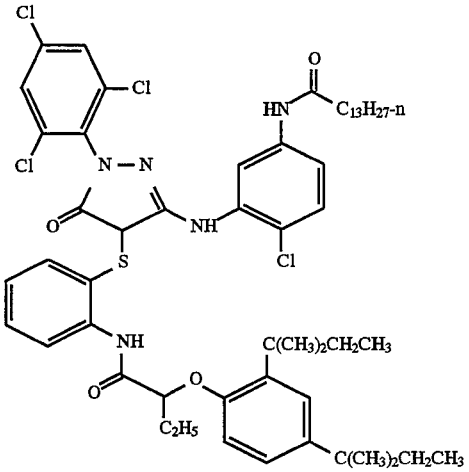
A-4
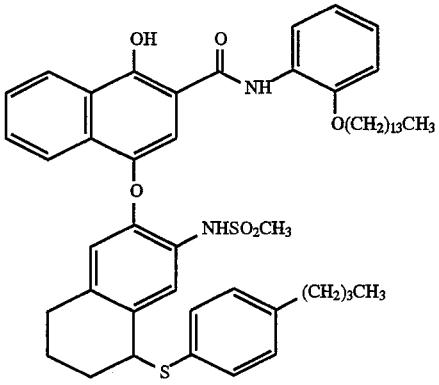
A-5
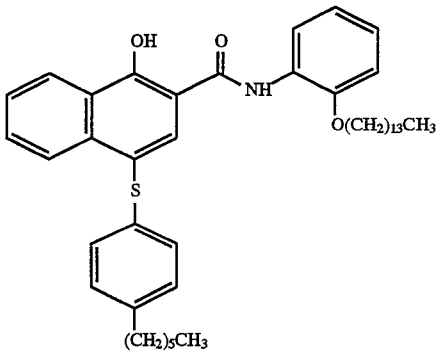
A-6
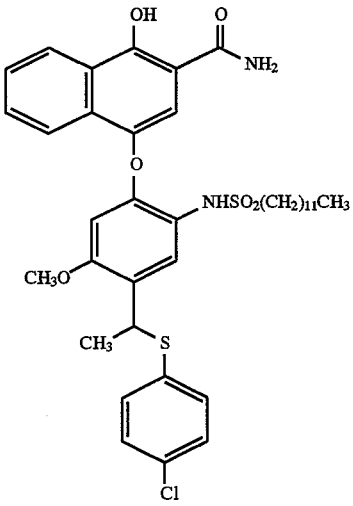
A-7
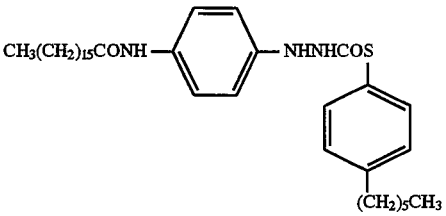
A-8
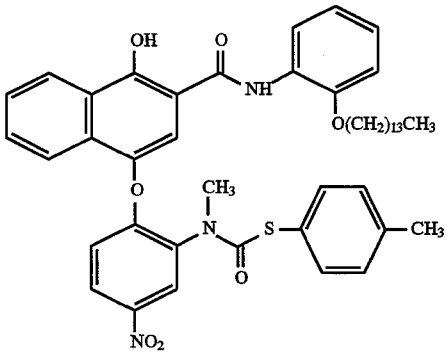

-continued
A-9
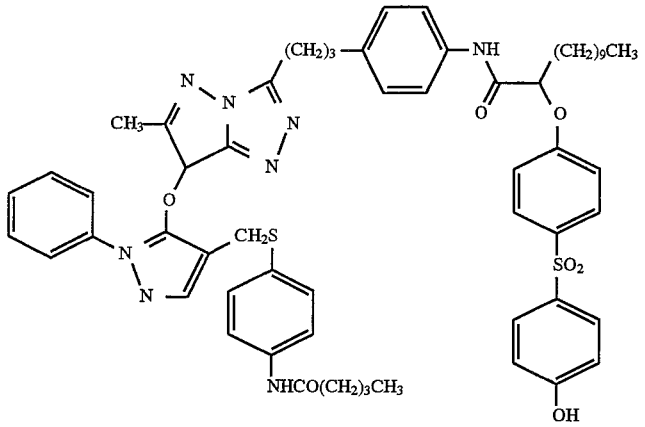
A-10
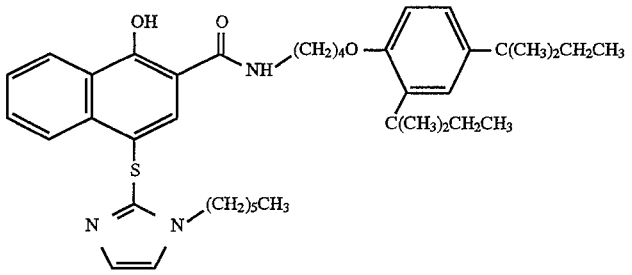
A-11
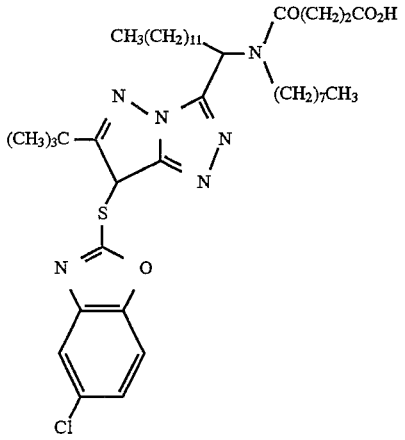
A-12
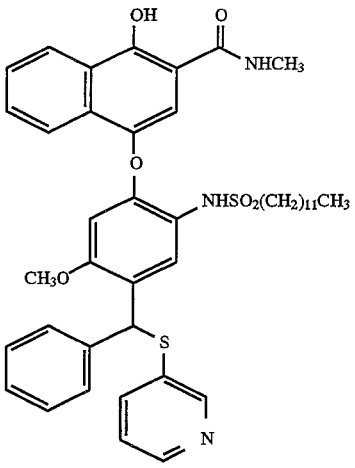
A-13
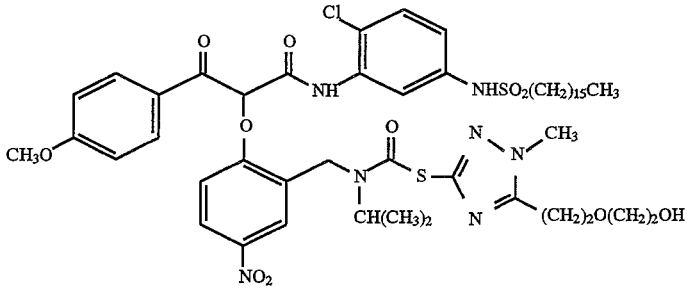

-continued

A-14

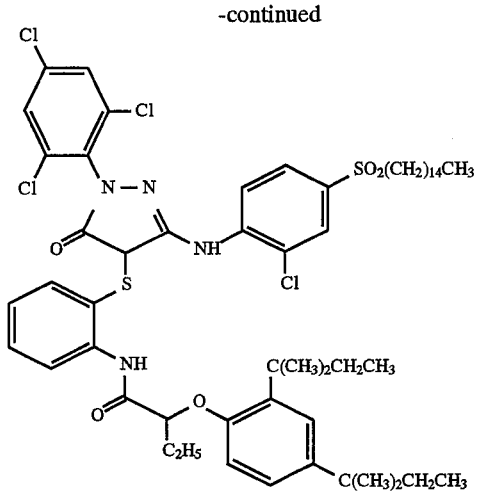

The multicolor photographic elements of this invention typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image forming units, can be arranged in various orders as known in the art. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The compounds A and B, or their precursors, are contained in one or more of the layers of the element so that they can interact with one another during photographic processing.

The element typically contains additional layers, such as filter layers, interlayers, overcoat layers, subbing layers, and the like. All of these can be coated on a support which can be transparent or reflective. Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and 4,302,523.

The compounds A and B are used in this invention to provide a masking effect in multilayer color photographic elements. The compounds can be contained in, or can be in reactive association with, one or more of the silver halide emulsion units in the color photographic element. If the carrier group of compound A is a coupler, it can form dyes of the same color as the dye-forming coupler or couplers in the layer or unit with which it is associated; or it can form a dye of a different color; or it can result in a colorless or neutral reaction product.

Compounds A and B can be located in the same layer of the photographic element or in separate layers. If they are in the same layer, it is possible to provide dye moieties for which stable release compounds are not available. If they are located in different layers, it is possible to locate compound B to eliminate or reduce any unwanted light absorption by its dye moiety on the layer containing compound A, or other layers. Depending on the particular dye moiety employed, one or the other of these configurations will be preferred. Similarly, depending on the particular compounds A and B, it may be desirable to have one of compounds A and B in a layer free of silver halide. In a preferred embodiment, compound A and compound B are incorporated in the same layer.

Both compounds A and B can be incorporated in the photographic element in a form which requires that they interact With a component of a processing solution before they are able to interact with each other to provide an unblocked dye moiety. In one embodiment, compound A is released imagewise as a function of silver halide development and compound B is released uniformly during processing in a form that will interact with the imagewise released compound A to provide an imagewise unblocking of the dye moiety.

In accordance with a preferred embodiment, compound A is released in an imagewise manner and compound B is present initially as a uniform distribution in a form which can interact with the imagewise released component so as to provide an imagewise unblocking of the dye moiety. Compound A, which is released, is the smaller more mobile component; and compound B, which is present as a uniform distribution, is relatively immobile.

In the following discussion of suitable materials for use in the emulsions and elements of this invention, reference can be made to *Research Disclosure,* February 1995, Item 37038, pages 78–114, and the patents and publications referred to therein, the disclosures of which are incorporated herein by reference; hereinafter referred to as "Research Disclosure 37038." Research Disclosure is published by Kenneth Mason Publications, Ltd., Dudley Annex, 12a North Street, Emsworth, Hampshire P010 7DQ, ENGLAND.

Suitable silver halide emulsions and their preparation, as well as methods of chemical and spectral sensitization, are described in Sections I through V of Research Disclosure 37038. Color materials and their constituents are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Methods of exposure are described in Section XVI of Research Disclosure 37038, and methods and materials for processing the elements to form a visible image are described in Sections XIX and XX of Research Disclosure 37038.

As indicated in Sections XIX and XX of Research Disclosure 37038, processing to form a visible dye image includes the step of contacting the element with a color developing agent to reduce developable silver halide and oxidize the color developing agent. Oxidized color developing agent in turn reacts with the coupler to yield a dye. Development is followed by the conventional steps of bleaching, fixing, or bleach-fixing, washing and drying.

The release of compound A and unblocking of compound B generally occurs during the development step. However, it is within the contemplation of this invention to provide compounds in which the release of compound A and/or the unblocking of compound B occur during a subsequent processing step, if it is desired that the dye moiety not be released until that step.

Compounds A and B of this invention can be prepared by techniques known in the art. Preparations of compounds A are shown in U.S. Pat. No. 5,354,650, the disclosure of which is incorporated hereinby reference. Preparations of compounds B are shown in the working examples, below, and preparations of compounds similar to compounds B of this invention, except for the solubilizing group, are shown in U.S. Pat. No. 5,455,141, the disclosure of which is incorporated herein by reference.

EXAMPLES

The following Examples illustrate the synthesis of a representative compound B useful in the invention and the preparation and use of single layer and multilayer photographic elements of the invention.

Example 1

Synthesis of Compound B-1

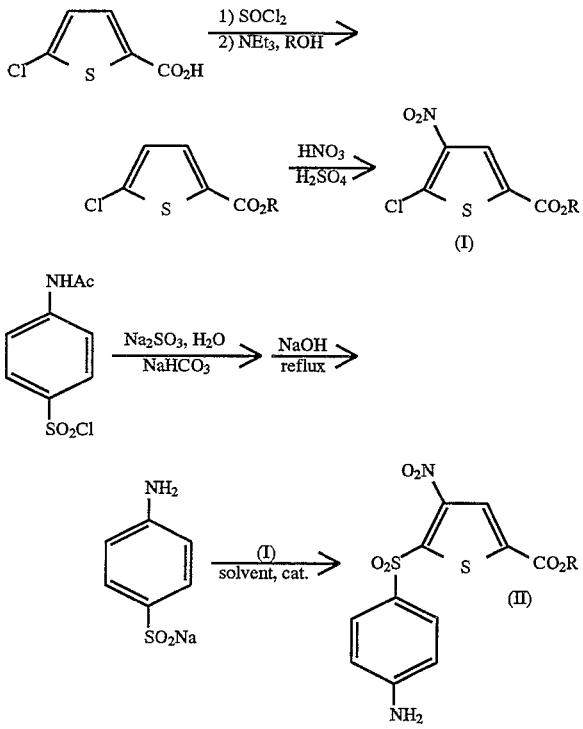

-continued

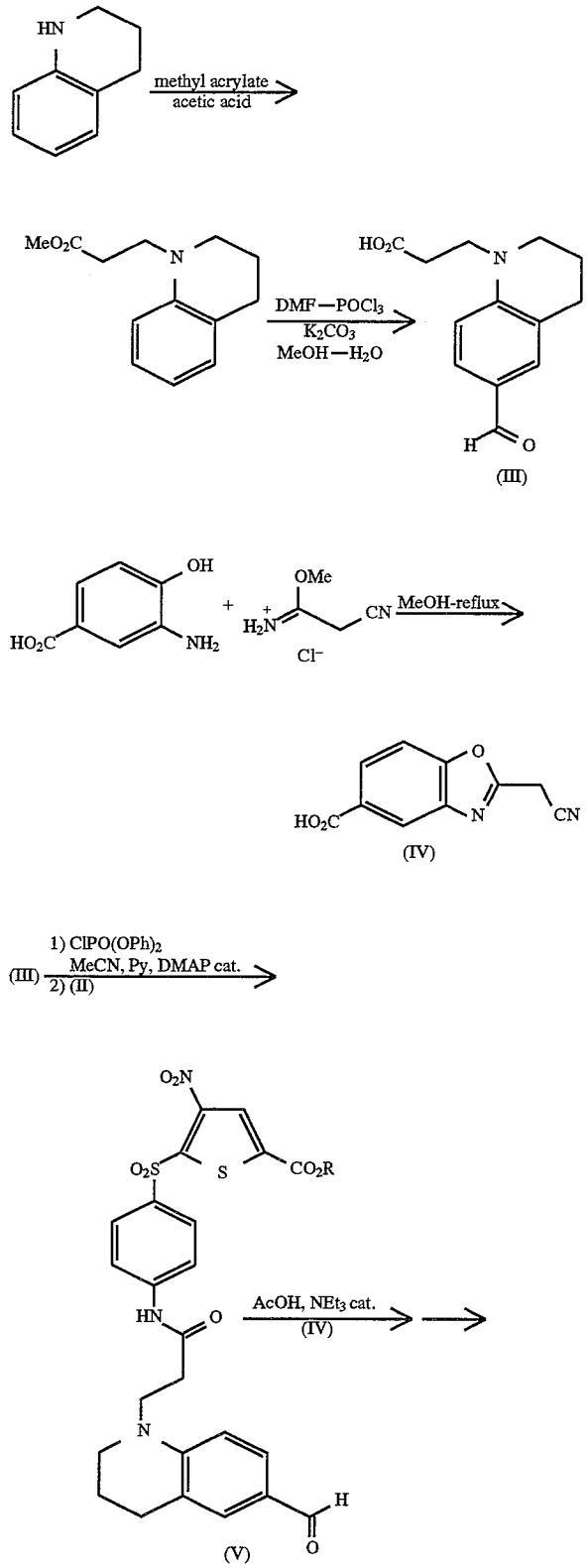

-continued

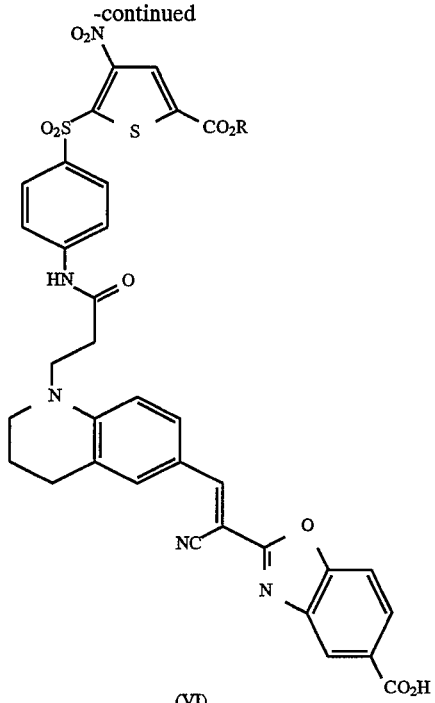

(VI)

R = $CH_2CH(C_6H_{13}\text{-n})C_8H_{17}\text{-n}$

Preparation of Compound (I)

A mixture of 5-chloro-2-thiophenecarboxylic acid (16.3 g, 100 mmol), toluene (50 mL) and 2 drops of dimethylformamide was treated with $SOCl_2$ (11 mL). After being stirred at 65° C. for 6 hours, all volatiles were removed under reduced pressure and the residue was dissolved in tetrahydrofuran (50 mL). This solution was added at 5° C. to a stirred solution of 2-hexyldecanol (23.03 g, 95 mmol) and pyridine (9.1 mL, 115 mmol) in 30 mL of tetrahydrofuran. Afterwards the stirring was continued at room temperature for 2 hours and then the mixture was worked up with water and ethyl acetate prior to drying and concentration. The crude ester was subject to nitration at 0° C. for 10 minutes using fuming nitric acid (4.4 mL, 105 mmol) and sulfuric acid (120 mL). The typical work up procedure using water and ethyl acetate was used to isolate the crude product (I) as an yellow oil (35.30 g, 86%).

Preparation of Compound (II)

To a vigorously stirred mixture of sodium sulfite (2.65 g, 21 mmol), sodium bicarbonate (3.61 g, 43 mmol), tetrabutylammoniumbromide (97 mg, 0.3 mmol), water (15 mL) and THF(15 mL) there was added N-acetylsulfanilyl chloride (2.33, 10 mmol) over a period of 15 minutes at ca. 45° C. After the addition was complete the stirring was continued for 2 hours and THF under water aspirator pressure. The residue was treated with water (5 mL) and sodium hydroxide (2.40 g, 60 mmol) and heated at reflux for 10 hours. The mixture was cooled to room temperature followed by addition of 6N HCl to adjust pH to ca. 7.5, warmed to 45° C. and treated with a solution of (I) (3.46 g, 8 mmol) and tetrabutylammonium bromide (97 mg, 0.3 mmol) in THF (10 mL). After being vigorously stirred for 20 minutes the mixture was cooled to room temperature, diluted with water (70 mL) and ethyl acetate (50 mL); the organic layers was separated, washed with water (100 mL) and dried over sodium sulfate. Removal of solvents provided 4.20 g(95%) of (II) as an orange oil.

Preparation of Compound (III)

A mixture of tetrahydroquinoline (13.32 g, 100 mmol), methyl acrylate (11.70 mL, 130 mmol), and acetic acid (12 mL) was stirred at 90° C. for 10 hours. The excess of methyl acrylate and acetic acid was removed under vacuum, and the residue was added in 10 mL of dried DMF to a Vilsmeier reagent, prepared from phosphorus oxychloride (9.30 mL, 100 mmol), and DMF (30 mL) at 0° C. After being stirred at 80° C. for 3 hours, the reaction mixture was cooled to room temperature, and poured into a solution of sodium acetate (30 g) and sodium chloride (30 g) in water (500 mL). The product was extracted with ethyl acetate (3×100 mL), the combined organic layers were washed with water (2×150 mL) and dried over magnesium sulfate prior to evaporation of solvent under reduced pressure. The crude ester was hydrolyzed in a solution of potassium carbonate(20 g) in 70% methanol (300 mL) over a period of 14 hours. The solution of the potassium salt of the carboxylic acid was concentrated under reduced pressure, the residue was diluted with 400 mL of water, and the resulting solution was acidified to pH 3 using 6N hydrochloric acid. Precipitated white solid material was isolated through filtration, washed with water (2×20 mL) and dried under reduced pressure (100 torr, 55° C.) to give 16.33 g (70%) of compound (III).

Preparation of Compound (IV)

A mixture of 3-amino-4-hydroxybenzoic acid (9.19 g, 60 mmol), cyanomethylmethoxyimmonium chloride (12.10 g, 90 mmol) and methanol (70 mL) were stirred at 55° C. for 2 hours. The excess of methanol was removed under reduced pressure and the residue was triturated with 200 mL of 7% sodium chloride. The product was collected, washed with cold water and dried overnight to yield 10.50 g (87%) of compound (IV).

Preparation of Compound (V)

To a mixture of III (2.68 g, 11.5 mmol), $Et_3N$ (1.61 mL, 11.5 mmol) and dichloromethane (12 mL) was added at 0° C. chlorodiphenyl phosphonate (0.91 mL, 11.5 mmol). After being stirred for 2 hours at 0° C. the mixture was warmed to room temperature, and subsequently treated with II (5.52 g, 10 mmol) in 10 mL of acetonitrile, pyridine (1.19 mL, 15 mmol) and DMAP (25 mg, 0.2 mmol). The stirring was continued for 10 hours, and the mixture was diluted with ethyl acetate (50 mL), washed with 2N hydrochloric acid, water and dried prior to evaporation of solvent. The residue was purified on silica gel using hexane-ethyl acetate as an eluent to yield 5.84 g (79%) of (V) as an creamy solid.

Preparation of Compound (VI)—Compound B-1

A solution of V (3.70 g, 5 mmol), IV (1.04 g, 5.15 mmol), $Et_3N$ (0.07 mL, 0.5 mmol) and acetic acid (25 mL) was stirred at 90° C. for 12 hours. During that time orange solid dye precipitated. The solid was collected, washed with acetic acid (5 mL), methanol (2×6 mL) and dried to yield 4.43 g (93%) of (VI), Compound B-1, as an orange solid.

Example 2

Single Layer Coatings

To compare the amount of released dye remaining in an element according to the present invention with the amount of released dye remaining with elements according to U.S. Pat. No. 5,455,141, single-layer photographic elements were prepared which differed only in the compound B contained in the element. The following layers were coated on a cellulose triacetate film support (coverage is in grams per meter squared). The structures of the compounds identified by letter and number (e.g. M-1) are shown following Example 3.

Element SL-1

Emulsion Layer: gelatin at 2.69, green sensitized silver bromoiodide (as Ag) at 1.61, magenta image coupler M-1 dispersed in an equal weight of dibutyl lauramide at 0.67.

(Coupler M-1 in this and the following example is the same as release compound A-3, shown above.)

Protective overcoat: gelatin at 2.69, bisvinylsulfonylmethyl ether at 1.75% total gelatin.

Element SL-2 was the same as Element SL-1 except that the dispersion of image coupler was replaced by a codispersion of magenta image coupler M-1 at 0.67 and comparative compound C-1 at 0.096 in an equal weight of dibutyl lauramide.

Element SL-3 was the same as Element SL-1 except that the dispersion of image coupler was replaced by a codispersion of magenta image coupler M-1 at 0.67 and inventive compound B-1 at 0.10 (equimolar to compound C-1) in an equal weight of dibutyl lauramide.

Strips of each element were exposed to green light through a graduated density step tablet and then developed for 3.25 minutes at 38° C. in the KODAK C-41 process to yield a negative density scale in magenta dye. The density to green and blue light was measured, and is reported Tables 1 and 2, below, in the minimum exposure region (Emin), at a midscale exposure (Emid), and in the maximum exposure region (Emax).

TABLE 1

| Green Density | | Dye | Emin | Emid | Emax |
|---|---|---|---|---|---|
| Element SL1 | Comparison | none | .28 | 1.21 | 2.30 |
| Element SL2 | Comparison | C-1 | .23 | 0.93 | 2.36 |
| Element SL3 | Invention | B-1 | .30 | 1.20 | 2.34 |

TABLE 2

| Blue Density | | Dye | Emin | Emid | Emax |
|---|---|---|---|---|---|
| Element SL1 | Comparison | none | .08 | 0.23 | 0.49 |
| Element SL2 | Comparison | C-1 | .50 | 0.34 | 0.75 |
| Element SL3 | Invention | B-1 | .36 | 0.26 | 0.50 |

TABLE 3

| Density Change | | Dye | Emin | Emid | Emax |
|---|---|---|---|---|---|
| SL2–SL1 | Comparison | C-1 | .42 | 0.11 | 0.26 |
| SL3–SL1 | Invention | B-1 | .28 | 0.03 | 0.01 |

Table 3 reports the change in blue density relative to the non-dye containing Element SL-1. The desired response would be the presence of blue density at Emin, less blue density at Emid, and little or no blue density at Emax. The presence of Compound C-1 in the photographic element gave a high level of blue density at Emin. At Emid, the amount of blue density was much lower, but at Emax there was too much blue density. The increase in retained blue density is believed to result from the reaction of the sulfinic acid Group on the dye moiety with excess oxidized color developer. Extraction and analysis via high pressure liquid chromatography of the Emax region of Element SL-2 showed a significant level of yellow dye which was not Compound C-1. In the case of the inventive compound B-1, a suitably high level of blue density was provided at Emin, but negligible amounts were present at Emid and Emax. Analysis of Element SL-3 showed a negligible level of retained yellow dye.

Example 3

Multilayer Elements

A multilayer photographic element was prepared by coating the following layers, in the order listed, on a cellulose triacetate film support (coverage are in grams per meter squared, emulsion sizes as determined by the disc centrifuge method and are reported in Diameter×Thickness in microns). The structures of the compounds identified by letter and number are shown following this example.

Element ML-1

Layer 1: (Antihalation layer): black colloidal silver sol at 0.322 and gelatin at 4.89.

Layer 2 (Slow cyan layer): a blend of two red sensitized (dye set 1) silver iodobromide emulsions: (i) a small tabular emulsion (1.1×0.09, 4.1 mole % I) at 0.437 and (ii) a very small tabular grain emulsion (0.5×0.08, 1.3 mole % I) at 0.534; gelatin at 1.78; cyan dye-forming coupler C-1 at 0.54; bleach accelerator releasing coupler BARC-1 at 0.038; masking coupler MC-1 at 0.027.

Layer 3 (Mid cyan layer): a red sensitized (same as above) silver iodobromide emulsion (1.3×0.12, 4.1 mole % I) at 0.700; gelatin at 1.79; C-1 at 0.210; DIR-1 at 0.010; MC-1 at 0.022.

Layer 4 (Fast cyan layer): a red-sensitized (same as above) tabular silver iodobromide emulsion (2.9×0.13, 4.1 mole % I) at 1.076; C-1 at 0.144; DIR-1 at 0.019; DIR-2 at 0.048; MC-1 at 0.032; gelatin at 1.45.

Layer 5 (Interlayer): gelatin at 1.29 and DYE-3 at 0.075.

Layer 6 (Slow magenta layer): a blend of two green sensitized (dye set 2) silver iodobromide emulsions: (i) 1.0×0.09, 4.1 mole % iodide at 0.303 and (ii) 0.5×0.08, 1.3% mole % I at 0.589; magenta dye forming coupler M-1 (dispersed at 1 M-1: 0.8 tritolylphosphate: 0.2 N,N-dibutyl-2-n-butoxy-5-t-octylaniline by weight) at 0.277; masking coupler MC-2 at 0.064; gelatin at 1.72.

Layer 7 (Mid magenta layer): a green sensitized (as above) silver iodobromide emulsion: 1.3×0.12, 4.1 mole % iodide at 0.968; M-1 (dispersed as above) at 0.069; MC-2 at 0.064; DIR-3 at 0.024; gelatin at 1.37.

Layer 8 (Fast magenta layer): a green sensitized (as above) tabular silver iodobromide (2.3×0.13, 4.1 mole % I) emulsion at 0.968; gelatin at 1.275; Coupler M-1 (dispersed as above) at 0.058; MC-2 at 0.054; DIR-4 at 0.0011 and DIR-5 at 0.0011.

Layer 9 (Yellow filter layer): YFD-1 at 0.108 and gelatin at 1.29.

Layer 10 (Slow yellow layer): a blend of three blue sensitized (with YD-A) tabular silver iodobromide emulsions: (i) 0.5×0.08, 1.3 mole % I at 0.270 (ii) 1.0×0.25, 6 mole % I at 0.375 and (iii) 0.81×0.087, 4.5 mole % I at 0.227; gelatin at 2.52; yellow dye forming couplers Y-1 at 0.753 and Y-2 at 0.290; DIR-6 at 0.064; C-1 at 0.027 and BARC-1 at 0.003.

Layer 11 (Fast yellow layer): a blend of two blue sensitized (as above) silver iodobromide emulsions: (i) a large tabular emulsion, 3.3×0.14, 4.1 mole % I at 0.227 and (ii) a 3-D emulsion. 1.1×0.4, 9 mole % I at 0.656; Y-1 at 0.204; Y-2 at 0.113; DIR-6 at 0.047; C-1 at 0.034; BARC-1 at 0.012 and gelatin at 1.57.

Layer 12 (UV filter layer): gelatin at 0.699; silver bromide Lippman emulsion at 0.215; DYE-1 at 0.011 and DYE-2 at 0.011.

Layer 13 (Protective overcoat): gelatin at 0.882.

Hardener (bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art.

Element ML-2 was prepared like Element ML-1 except that in Layer 6, the laydown of M-1 was adjusted to 0.16, MC-2 was removed and replaced by a codispersion of M-1 and compound C-2 (2.3 M-1: 1 DYE C2: 2.97 tritolylphosphate: 0.33 N,N-dibutyl-2-n-butoxy-5-t-octylaniline by weight) at 0.116 based on M-1 (total laydown of M-1 =0.277). In Layer 7, M-1 and MC-2 were removed and replaced by the same codispersion of M-1 and compound C-2 at 0.116 of M-1. In layer 8, M-1 and MC-2 were removed and replaced by the same codispersion of M-1 and compound C-2 at 0.09 of M-1.

Element ML-3 was prepared like Element ML-2 except that a codispersion of M-1 and compound B-2 (2.4 M-1: 1, B-2: 3.06 tritolylphosphate: 0.34 N,N-dibutyl-2-n-butoxy-5-t-octylaniline by weight) was used in place of the codispersion of M-1 and compound C-2.

These multilayer film elements were given a stepped exposure of the green layer only using a WRATTEN IF550 filter and processed to form an image using the KODAK C-41 process. Blue and green densities were measured at Emax (maximum exposure), and Emin (minimum exposure=maximum exposure+4.0 neutral density filter). Residual masking dye and the corresponded trapped Dox adduct were measured by extraction and HPLC analysis using standard analytical techniques and are expressed in millimoles per square meter in Table 4, below. The results reported in this table show that sixty percent of the dye released from compound C-2 at Emax was trapped and retained, whereas no retained release dye was detected from the inventive compound B-2.

TABLE 4

| | ML-1 (Comparison) | ML-2 (Comparison) | ML-3 (Invention) |
|---|---|---|---|
| Blue Emin | 0.856 | 0.841 | 0.781 |
| Green Emin | 0.626 | 0.551 | 0.566 |
| Blue Emax | 0.816 | 0.813 | 0.789 |
| Green Emax | 2.481 | 2.246 | 2.297 |
| Total Dye coated | | 0.21 | 0.21 |
| Remaining Dye at Emax | | 0.060 | 0.043 |
| Retained Dox adduct at Emax | | 0.09 | None detected |

The structures of the compounds used in Examples 2 and 3 are shown below.

C-1

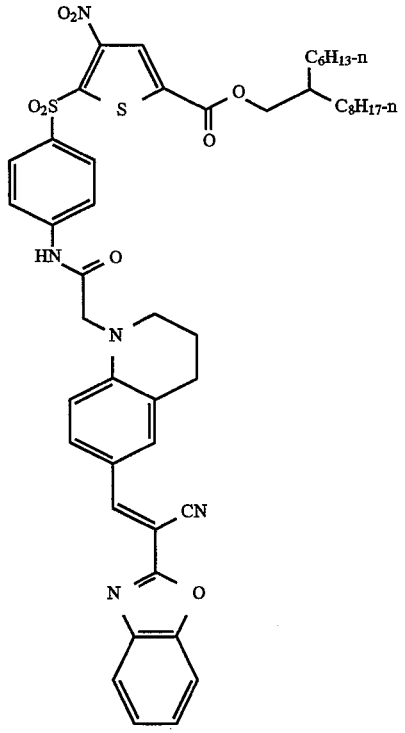

-continued
C-2
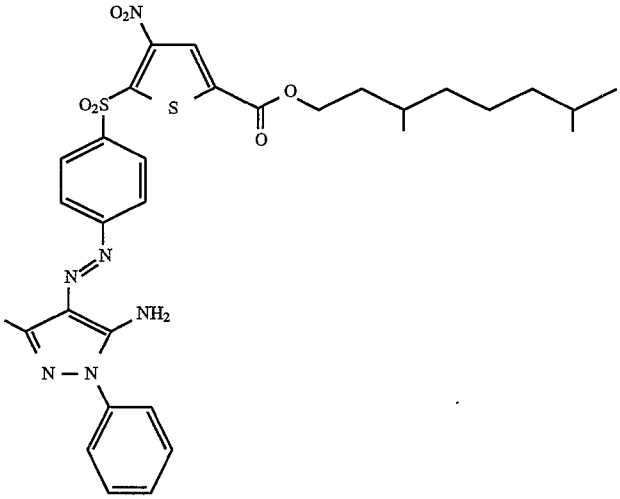
B-1
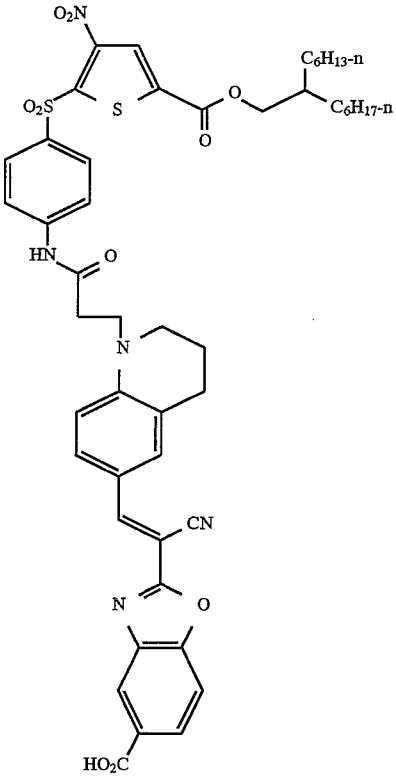

-continued
B-2
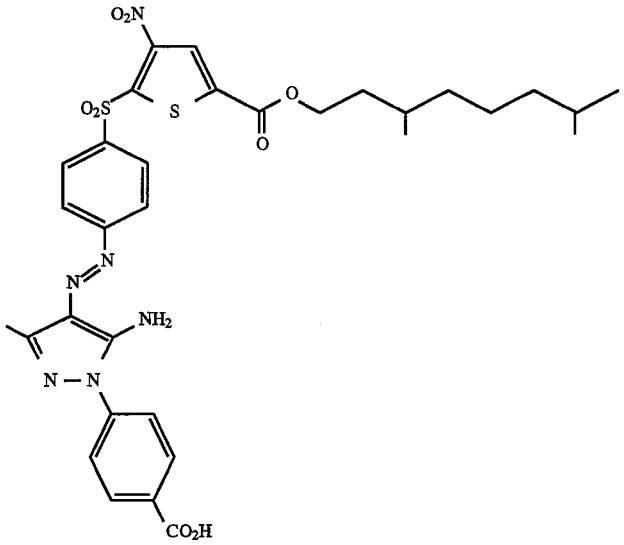
Sensitizing Dye Set 1: CD-A:CD-B at 9:1
CD-A:
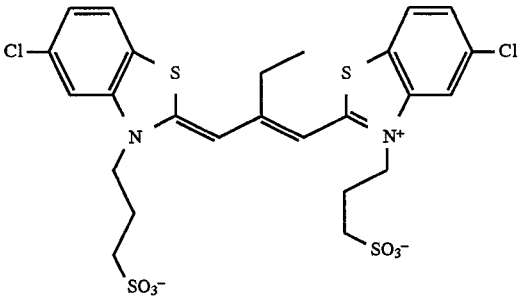
Sensitizing Dye Set 2: MD-A:MD-B at 6:1
CD-B:
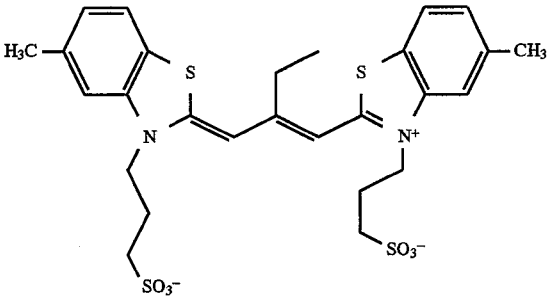
MD-A:
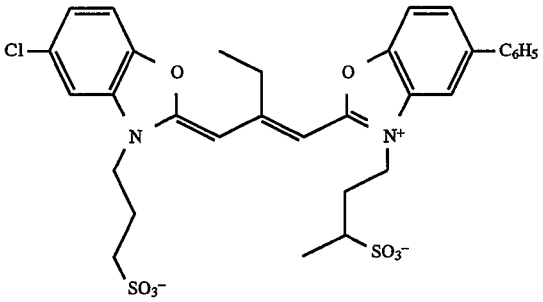
MD-B:
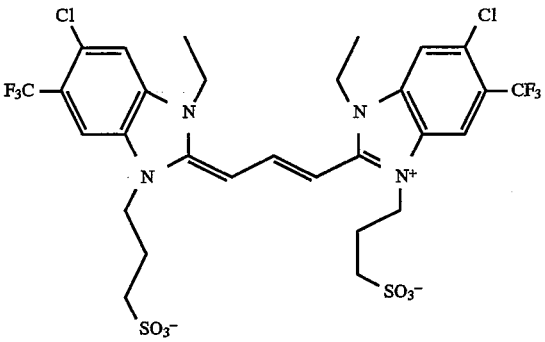
YD-A:
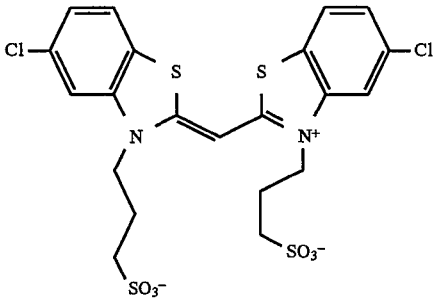
DYE-1:
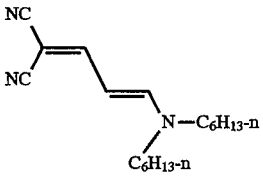

-continued
DYE-2:
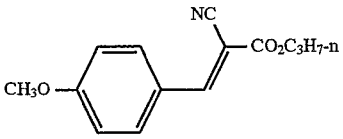
DYE-3:
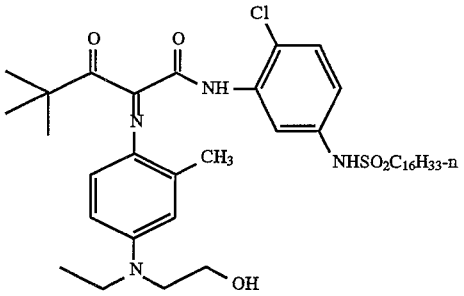
Y-1:
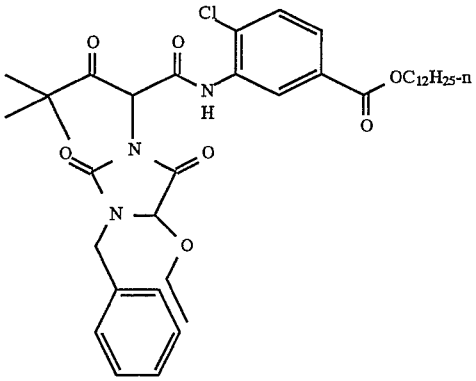
Y-2:
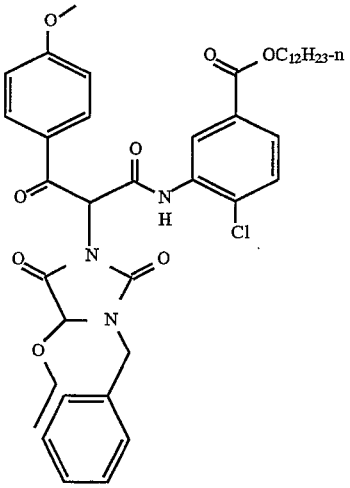
YFD-1:
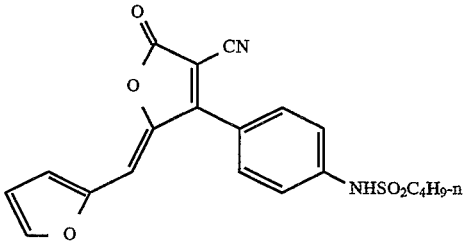
C-1:
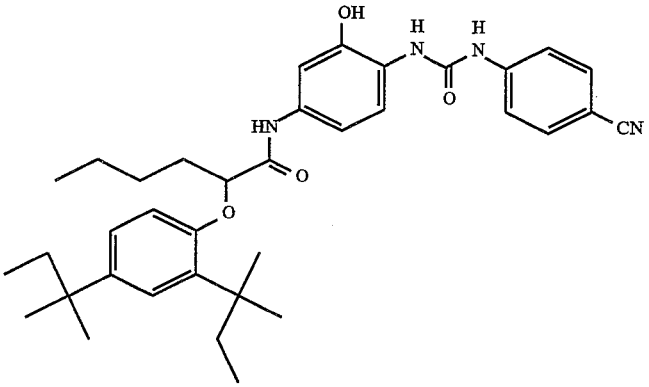

-continued
BARC-1:
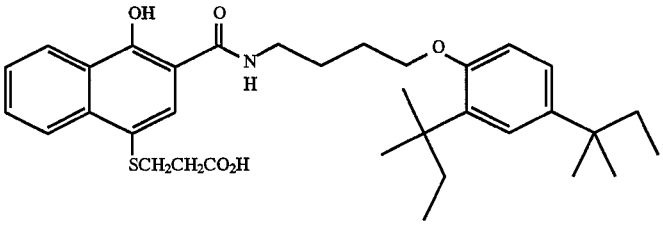
MC-1:
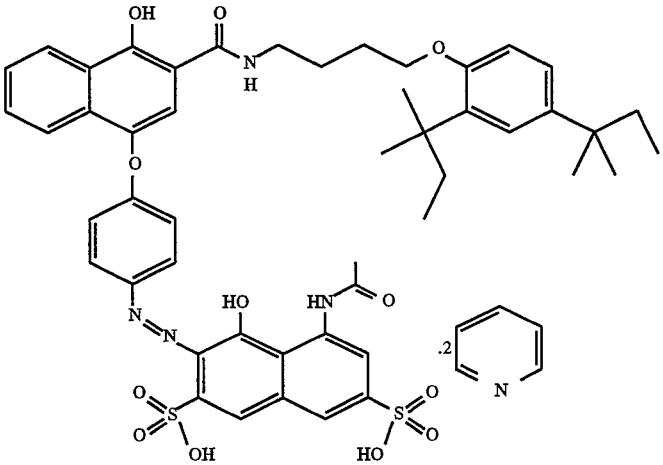
DIR-1:
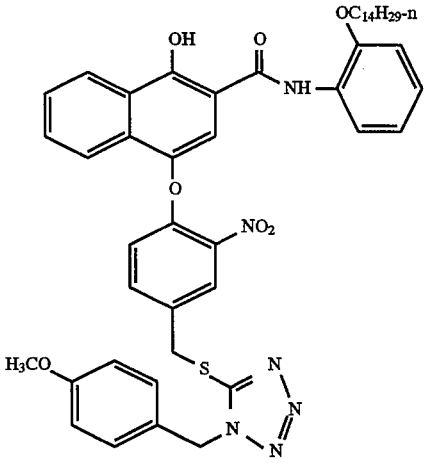
DIR-2:
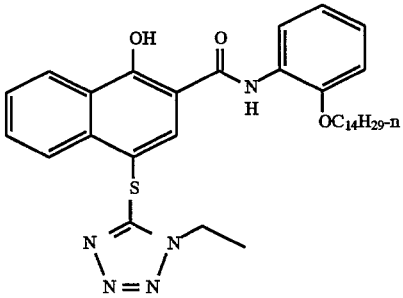

-continued
M-1
(A-3):
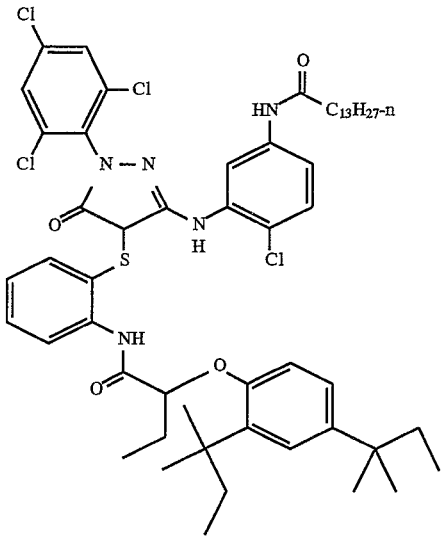
MC-2:
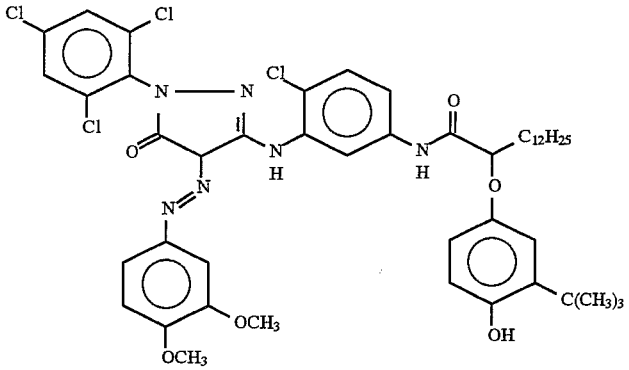
DIR-3:
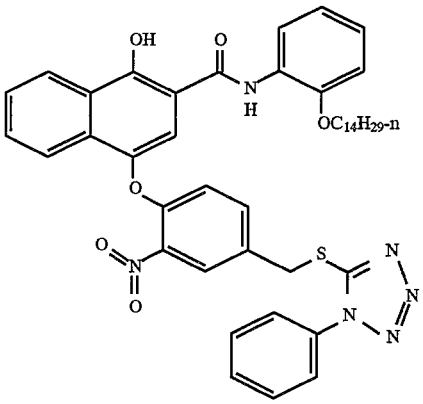

-continued
DIR-4
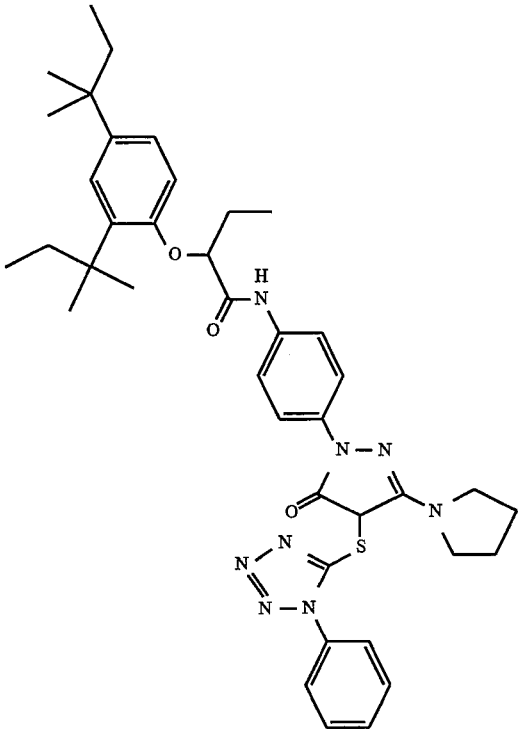
DIR-5:
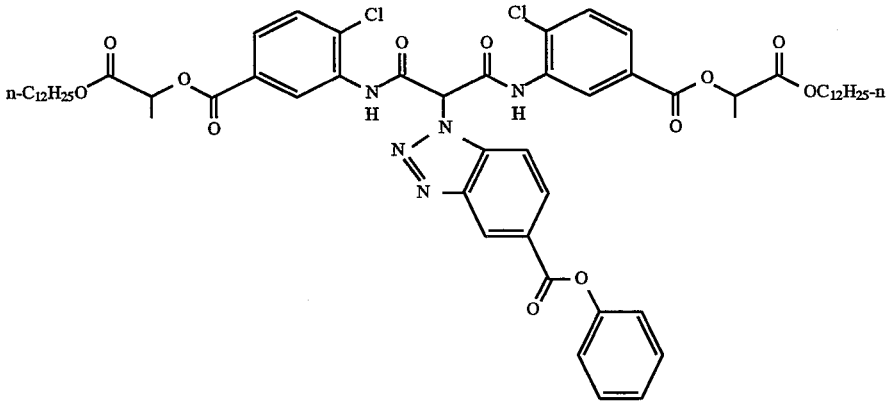

-continued

DIR-6:

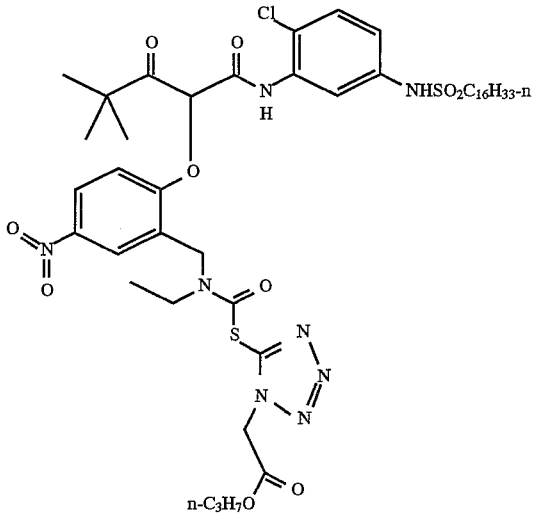

The invention has been described in detail with particular reference to preferred embodiments thereof, but it will be understood that variations and modifications can be effected within the spirit and scope of the invention.

What is claimed is:

1. A multilayer color photographic element comprising:

a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler; and associated with at least one of the dye image-forming units, a) a release compound that provides an imagewise distribution of a compound A, compound A comprising a nucleophile that is imagewise releasable from a carrier group as a function of silver halide development; and b) a uniform distribution of a compound B, compound B comprising a solubilized dye moiety joined by a sulfinate linkage to a blocking group which immobilizes the dye moiety in the element and from which it is displaceable by compound A wherein the dye moiety of compound B contains one or more functional groups that are at least 10% ionized at pH 10;

compounds A and B, under photographic processing conditions, being capable of interacting to provide an unblocked, mobile, solubilized dye moiety.

2. A photographic element of claim 1, wherein compound B and the compound which provides compound A are in the same layer.

3. A photographic element of claim 1, wherein compound B and the compound which provides compound A are in different layers.

4. A photographic element of claim 1, wherein the compound which provides compound A is a pyrazolone coupler that has a thiol nucleophile in its coupling position.

5. A photographic element of claim 1, wherein the nucleophile released by compound A is an aryl, alkyl or heterocyclic thiol.

6. A photographic element of claim 1, wherein compound B has a structural formula selected from:

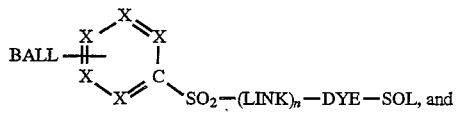

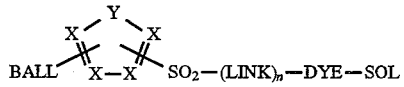

wherein:

X is N or C—R;

Y is O, S, or N—R;

R is H or a monovalent substituent;

BALL is a ballast group which renders the compound immobile in the layer in which it is coated;

LINK is a linking group;

n is 0, 1 or 2; and

DYE-SOL is a solubilized dye moiety.

7. A photographic element of claim 6, wherein the dye moiety of compound B is an unshifted dye moiety.

8. A photographic element of claim 1, wherein compound B has a structural formula selected from:

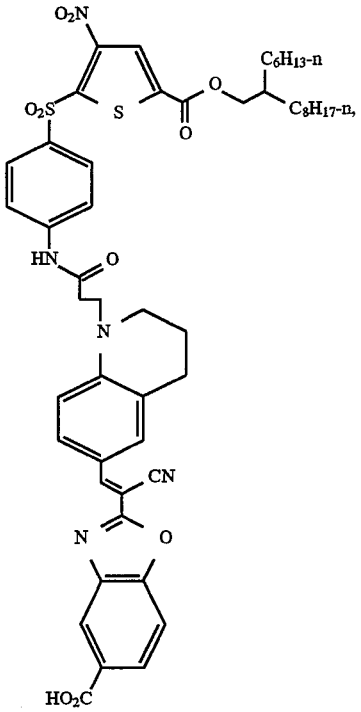

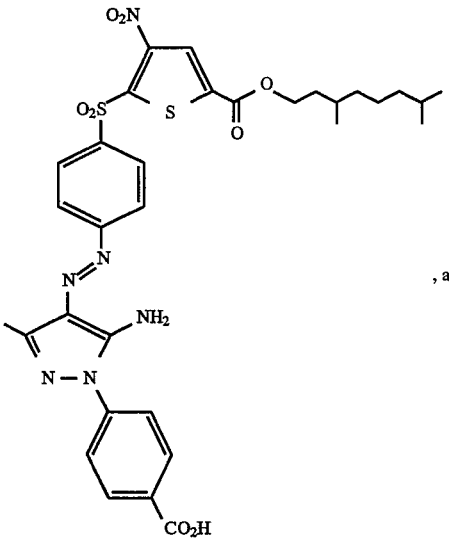

, and

-continued

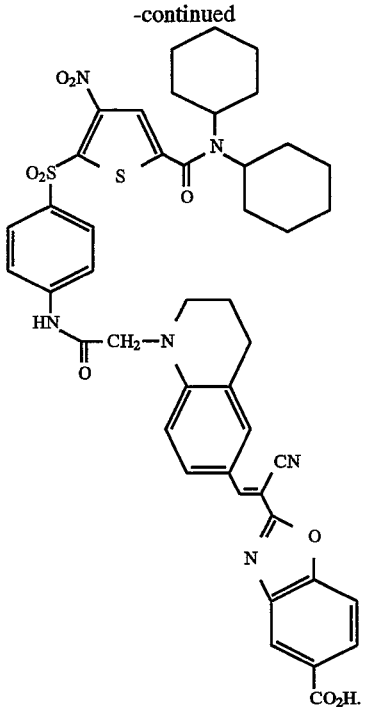

9. A photographic element of claim 1, wherein the dye moiety of compound B contains one or more carboxylic acid, sulfonic acid, acidic sulfonamide or phenol groups, or a salt of such a group.

10. A multilayer color photographic element comprising:

a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler; and associated with at least one of the dye image-forming units, a) a release compound that provides an imagewise distribution of a compound A, compound A comprising a nucleophile that is imagewise releasable from a carrier group as a function of silver halide development: and b) a uniform distribution of a compound B, compound B comprising a solubilized dye moiety joined by a sulfinate linkage to a blocking group which immobilizes the dye moiety in the element and from which it is displaceable by compound A wherein the dye moiety of compound B is a dicyano methine dye or a cyanomethanesulfonyl methine dye;

compounds A and B, under photographic processing conditions, being capable of interacting to provide an unblocked, mobile, solubilized dye moiety.

11. A photographic element of claim 10, wherein compound B and the compound which provides compound A are in the same layer.

12. A photographic element of claim 10, wherein compound B and the compound which provides compound A are in different layers.

13. A photographic element of claim 10, wherein the compound which provides compound A is a pyrazolone coupler that has a thiol nucleophile in its coupling position.

14. A photographic element of claim 10, wherein the nucleophile released by compound A is an aryl, alkyl or heterocyclic thiol.

15. A photographic element of claim 10, wherein compound B has a structural formula selected from:

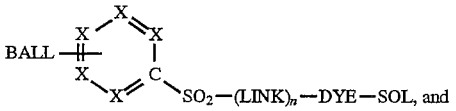

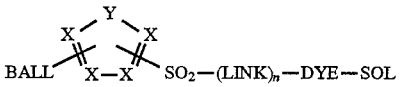

wherein:

X is N or C—R;

Y is O, S, or N—R;

R is H or a monovalent substituent;

BALL is a ballast group which renders the compound immobile in the layer in which it is coated;

LINK is a linking group;

n is 0, 1 or 2; and

DE-SOL is a solubilized dye moiety.

16. A photographic element of claim 15, wherein the dye moiety of compound B is an unshifted dye moiety.

17. A photographic element of claim 10, wherein compound B has a structural formula selected from:

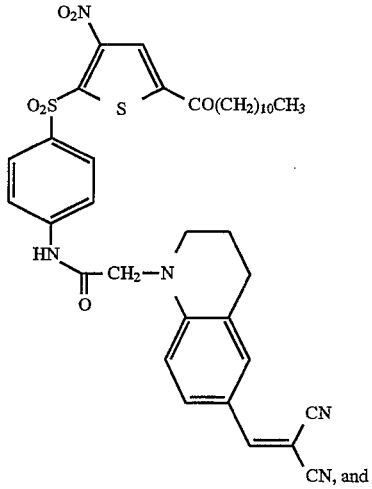

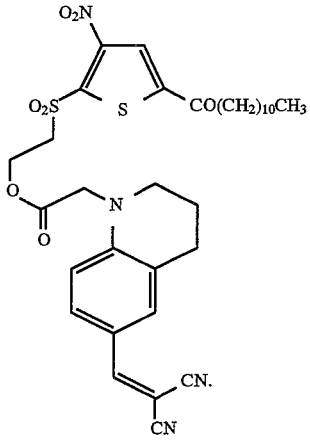

* * * * *